US008330080B2

(12) United States Patent
Fernandez et al.

(10) Patent No.: US 8,330,080 B2
(45) Date of Patent: Dec. 11, 2012

(54) ELECTRIC OVEN WITH ADJUSTABLE HEATING ELEMENT

(75) Inventors: Juan Fernandez, Towaco, NJ (US); Juan David Londoño Restrepo, Gijon (ES)

(73) Assignee: Fotocristal 3D S.L., Gijon (ES)

( * ) Notice: Subject to any disclaimer, the term of this patent is extended or adjusted under 35 U.S.C. 154(b) by 276 days.

(21) Appl. No.: 12/762,478

(22) Filed: Apr. 19, 2010

(65) Prior Publication Data

US 2010/0270282 A1 Oct. 28, 2010

Related U.S. Application Data

(60) Provisional application No. 61/276,718, filed on Sep. 16, 2009, provisional application No. 61/284,180, filed on Dec. 14, 2009.

(51) Int. Cl.
*F27D 5/00* (2006.01)

(52) U.S. Cl. ..... 219/392; 219/405

(58) Field of Classification Search ..... 292/392, 292/405, 406, 411
See application file for complete search history.

(56) References Cited

U.S. PATENT DOCUMENTS

| | | | | |
|---|---|---|---|---|
| 4,350,197 | A * | 9/1982 | Haller | 160/168.1 R |
| 6,250,214 | B1 * | 6/2001 | Backus et al. | 99/419 |
| 6,723,962 | B1 * | 4/2004 | Sit | 219/404 |
| 7,105,778 | B1 | 9/2006 | DeLong | |
| 7,317,174 | B2 | 1/2008 | Lau | |
| 2003/0168438 | A1 * | 9/2003 | Zhou | 219/386 |
| 2007/0114220 | A1 * | 5/2007 | De'Longhi | 219/392 |
| 2007/0241094 | A1 * | 10/2007 | Lau et al. | 219/404 |
| 2009/0107343 | A1 | 4/2009 | De' Longhi | |

* cited by examiner

*Primary Examiner* — Julio J Maldonado
*Assistant Examiner* — Robert Bachner
(74) *Attorney, Agent, or Firm* — Gearhart Law, LLC

(57) ABSTRACT

The present invention is an improved electronic oven; a table-top, or toaster oven that contains a vertically moveable heating element. The moveable heating element allows a range of foods and/or portions of food to be cooked or heated in the most efficient manner possible, saving time and energy use. A heat directing plate disposed above the moveable heating element further increases efficiency by directing heat onto the food.

17 Claims, 15 Drawing Sheets

ELECTRIC OVEN WITH ADJUSTABLE HEATING ELEMENT

CLAIM OF PRIORITY

This application is claiming the priority of the U.S. Ser. No. 61/276,718 filed on Sep. 16, 2009, of the U.S. Ser. No. 61/284,180 filed on Dec. 14, 2009, of the U.S. Ser. No. 29/348,248 filed on Dec. 14, 2009, of the Chinese Serial No. 200920157037.X filed on May 27, 2009, and of the Chinese Serial No. 2009301875388 filed on Apr. 28, 2009, the contents of which are fully incorporated herein by reference.

FIELD OF THE INVENTION

The invention relates to the field of electric ovens, in particular to tabletop or toaster ovens.

BACKGROUND OF THE INVENTION

Table top, or toaster ovens have become popular home appliances in many households. One reason is because using a toaster oven saves energy since it takes less energy to heat a smaller oven cavity than a standard wall oven, and the toaster oven can heat up more rapidly, thus decreasing cooking time. One limitation of a tabletop oven in relation to a full size wall oven is the fixed distance between the baking rack or tray and the heating element; in a wall oven, the baking rack is adjustable, so the food can be placed as close to the heating element as desired. If the toaster oven were engineered such that the position of the heating element relative to the baking tray could be adjusted so that the food is closer to the element, the baking time could be decreased and less power could be used, particularly when thinner food such as bread is cooked. The present invention may also preferably include a heat directing plate, which reflects heat from the heating elements back toward the food item, thus maximizing energy efficiency by minimizing heat dissipation.

Another advantage of a moveable heating element is that the user does not have to open the oven to get the food closer to the heat, as when a baking rack is moved. Further, a moveable heating element provides a measure of safety in that the user can move the heating element close to the food for cooking, then move the heating element away from the food when the food is removed from the electronic oven, thereby reducing the possibility of being burned by the heating element.

Attempts have been made to design more efficient tabletop and toaster ovens. Art in this area is described below.

U.S. Pat. No. 6,250,214 discloses an enclosed rotisserie with added convenience, including a countertop resting box-like enclosure housing a safety rear mounted heating element and a power rotated dual rod spit assembly. The gear driven spit assembly may be easily inserted and removed straight into and out of the enclosure without need for angling or coupling the assembly to a power drive socket. The spit assembly may also be mounted at various distances from the heating element to decrease cooking times. The open front of the enclosure is from time to time covered by an inclined glass panel door which may be opened in various ways to facilitate food insertion into and removal from the enclosure, and which may be easily removed for cleaning or other purposes. The embodiment's design makes efficient use of valuable counter space by recessing back and raising off the countertop its controls. Two countertop supported sizes for the embodiment are suggested, one for larger families and entertaining, and the other for small families and singles. Maintenance is minimized by various embodiment parts being removable for cleaning including a cleaning shield located behind the heating element, the glass door, and a drip pan with slotted cover. A variety of foods may be cooked using the spit and accessories that attach to the spit. Such accessories include wire baskets and a rotating stir fryer. Self-rotating kabob rods cook kabobs on all sides evenly and allow for increasing rotisserie capacity by increasing the length of rotating rods available for rotisserie food mounting.

U.S. Pat. No. 7,105,778 describes A combination toaster oven and toaster appliance for cooking and heating foodstuff including a housing defining a food cavity therein and a heating element mounted in the housing for heating the food cavity. The housing includes a top wall and a front wall. A slot is located in the top wall and a door is movably mounted to the front wall. A toaster oven opening is located in the front wall and provides access to the food cavity. The door is movable between a closed position wherein the door covers the toaster oven opening and an open position wherein the door exposes the toaster oven opening and food cavity. A slot cover is movable between an extended position covering the slot and a retracted position exposing the slot.

U.S. Pat. No. 7,317,174 describes a food heating or cooking appliance that has at least one electrical heating element within its interior that is adjustable in position so as to be able to be moved close to thin or small food items under the control of a manually actuated control. A separator plate that extends across the interior chamber of the appliance from side to side and from front to back is movable with the heating element to enable adjustment of the volumetric size of the cooking chamber containing the heating element and the food to be heated or cooked. A manual actuator, a knob or lever, for example, moves the heating element and the separator plate through a motion transfer bar that extends across the width of the appliance and is attached to a linkage on each side of the appliance to communicate movement to a pair of movable supports supporting the rod-like heating element at each of its ends and the separator plate at opposite edges.

The present invention has advantages the prior art lacks. It can cook a greater variety of foods than inventions detailed in some of the examples of the prior art above. The mechanism for moving the heating element in the present invention is elegant in its simplicity, making the present invention easier to maintain, less expensive to manufacture, and easier to use than examples in the prior art.

In the closest prior art, U.S. Pat. No. 7,317,174, the mechanism contains a number of moving parts including a slide bar that can easily jam or bend. In one embodiment of the present invention, the scissoring mechanism yields a fluid, smooth movement that can be stopped with the heating element at any position in the electronic oven body.

In both embodiments of the present invention, the interactive connecting rods are larger and sturdier than the mechanism of the prior art. This allows more force to be applied to the mechanism in a more symmetrical manner, which allows for smoother movement of the mechanism and the heating element than do the smaller slide bars of the prior art. Additionally, the present invention contains stabilizing rods to keep the support and mechanism stable as the heating element moves up and down.

In a preferred embodiment of the present invention, an ingenious interlocking vertical track and interlocking mechanism add great stability to the invention. None of the prior art discloses this interlocking mechanism, and it is believed that this is a novel mechanism.

Another feature of the present invention is that the control knob is connected to a cam mechanism that has multiple preset positions in a preferred embodiment. This increases safety as it also helps keep the heating element in place.

The present invention is an electric oven that has a moveable heating element and a top reflector plate such that the volume of heated space inside the oven is minimized yet is sufficient to cook the desired food.

The invention is an article of manufacture, an electric oven having a body for holding food, with at least one heating element within the body; vertical side slots installed symmetrically on a right side wall and a left side wall of the body with a terminal to connect the heating element to a mechanism art the vertical side slots; and a mechanism that drives movement of the heating element in the vertical direction along the vertical side slots.

The mechanism includes a lifting unit, which in one embodiment is a diamond shaped frame formed by four interactive connecting rods. Two upper interactive connecting rods form the top section of the diamond and are connected with the support, which may be a horizontal bar, and two lower inactive connecting rods form the bottom section of the diamond, and are connected to the revolving shaft that passes horizontally through the oven wall at the bottom of the left and right side walls of the body. The diamond shaped frame uses components, including but not limited to, pins, hinges, or joints at the intersection of the interactive connecting rods to connect them and also allow them to move in a pivoting action when an adjustable knob is turned and the revolving shaft is activated.

The connecting section of the revolving shaft is square and the corresponding hole of one of the lower interactive connecting rods is square to avoid slip, while the corresponding hole of the other lower interactive connecting rod is round. When the revolving shaft is rotating, the interactive connection rod with the corresponding square hole will be driven so that the interactive connection rod linked to it will be driven upward or downward, and, as a result, upward or downward movement of the heating element will be achieved. An adjustable knob is installed at the outer side wall of the electric oven, with the revolving shaft connected to it so that the motion of the shaft, and therefore the position of the heating element, can be controlled by a user.

When the knob is turned to the 'low' position, the four rods are in the collapsed position; when the knob is turned to the 'high' position, the four rods are in the extended position. The knob can be set so that the heating element stops at any of four points; in an alternate embodiment the heating element can be set at any interval between the high and low positions.

The mechanism is disposed on both the left side and the right sides of the electric oven, with identical elements of the mechanism on both sides except for the adjustable knob, which is disposed on only one side of the electric oven. In a preferred embodiment, the mechanism is concealed by an outer wall, so that is disposed between an inner and outer oven wall, and is not visible unless the oven is disassembled. Disposing the mechanism on both the right and left sides of the electric oven adds to the stability of the heating element in any vertical position. A spring may also be disposed on the mechanism to add stability and safety. In addition, there are stabilizing rods located on each side of the electric oven that stabilize and smooth the movement of the heating element.

In order to heat food more quickly, a heat reflecting plate may be disposed above the heating element to reflect heat down onto the food. The heat reflecting plate is disposed such that it moves with the heating element, by affixing it to one or more sides of the heating element. Alternately, the heat reflecting plate may move independently of the heating element.

A second embodiment of the invention is an article of manufacture that is an electric oven having a body for holding food with a vertically moveable heating element; an L-shaped lifing unit with a lower interactive connecting rod and an upper interactive connecting rod; an attached spring connected to a support bar that traverses vertical tracks; and a terminal to connect a heating element to the lifting unit.

The present invention is an improvement over the prior art because it has a design that is versatile, yet less complicated and therefore easier and less expensive to manufacture.

It is an object of the invention to provide a faster cooking method for small volumes of food.

It is an object of the invention to use less energy for cooking food.

It is an object of the invention to provide a means to adjust the volume of space that must be heated to cook food.

It is an object of the invention to provide a tabletop electric oven with an adjustable heating element.

It is an object of the invention to provide a tabletop electric oven with a heat reflecting plate above the upper heating element.

It is an object of the invention to provide a tabletop electric oven with an adjustable heating element that is easy to use.

It is an object of the invention to provide an improved mechanism for adjusting the height of the heating element in a tabletop electric oven.

DESCRIPTION OF THE PREFERRED EMBODIMENTS

Figure 1:
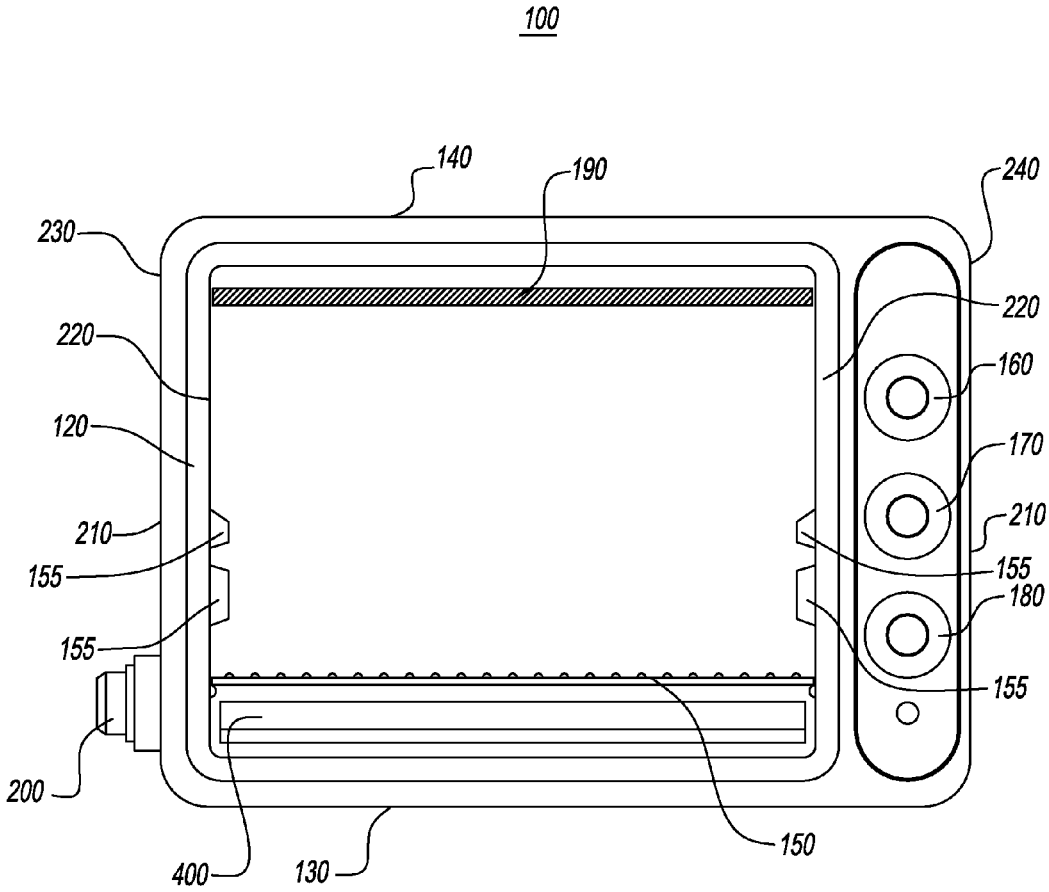
FIG. 1 is a front view of the invention.
Figure 2:
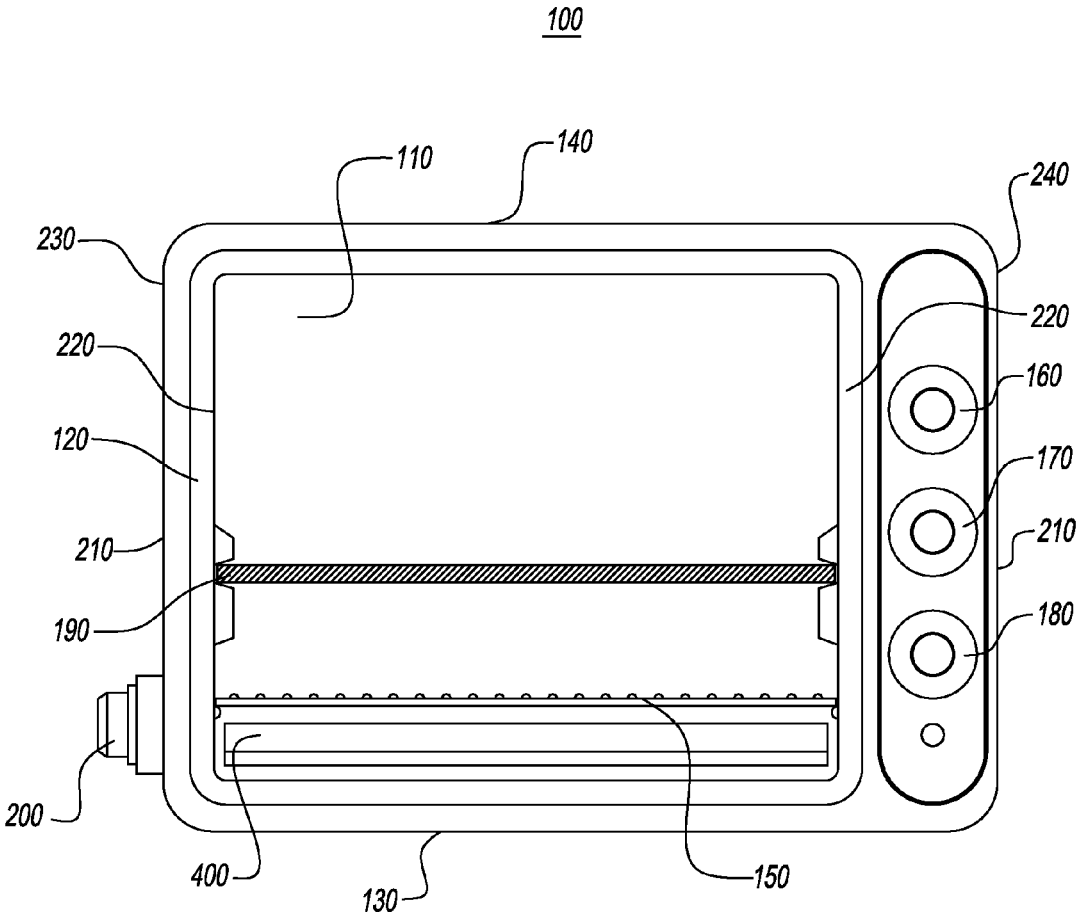
FIG. 2 is a front view of the invention.
Figure 3:
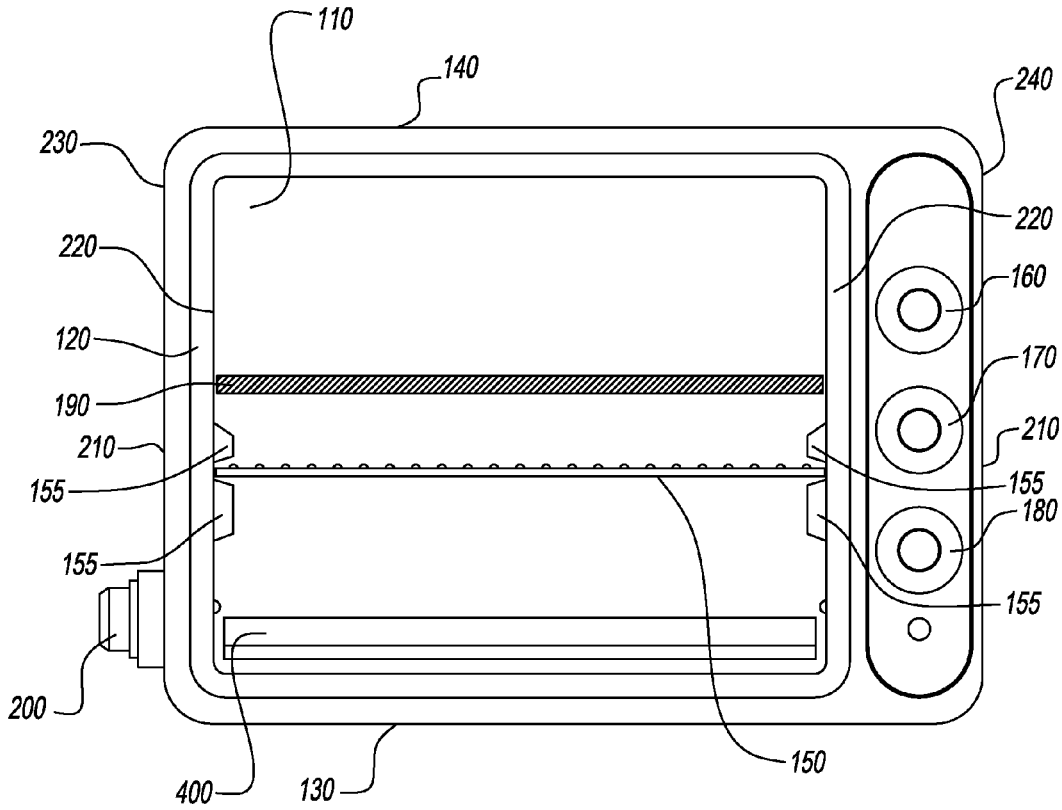
FIG. 3 is a front view of the invention.

FIGS. 1-3 are front views of a preferred embodiment of the invention. FIG. 1 shows the heating element in the topmost position in the electric oven with the food tray at the bottom of the electric oven, FIG. 2 shows the heating element in a lower position with the food tray at the bottom of the electric oven, and FIG. 3 shows the heating element in the middle of the oven with the food tray raised to a higher position in the oven.

FIG. 1 is a front view of a preferred embodiment of the invention. FIG. 1 shows electric oven 100, with electric oven body 110, which is also known as the body for holding food, electric oven door 120, electric oven bottom 130, electric oven top 140, food rack 150, food rack positioning tabs 155, heat setting 160, time setting 170, temperature setting 180, heating element 190, adjustable knob 200, outer side wall 210, inner side wall 220, right side wall 230, left side wall 240, and revolving shaft 400.

FIG. 1 illustrates the configuration of the invention in the manner that a typical toaster oven or tabletop oven is used; the heating element 190 is at the very top of the oven body 110, and the food rack 150 is at the bottom of the inside of the oven. There may also be a heating element 190 under the food rack, and there may be a tray that fits onto the food rack. The food rack 150 can be any shape or size, but is preferably flat to increase the versatility of the space usage in the oven body 110. The revolving shaft 400 may be inside the oven body 110, or anywhere outside the oven body 110, as long as it is linked to the adjustable knob 200 and the lower interactive connecting rod. The food rack 150 and any optional food tray may be made from any material that can withstand heat, including but not limited to, metals, plastics, rubbers, or glass or combinations or composites of these or any other materials.

FIG. 2 is a front view of a preferred embodiment of the invention. FIG. 2 shows electric oven 100, electric oven body 110, electric oven door 120, electric oven bottom 130, electric oven top 140, food rack 150, temperature setting 160, time setting 170, function setting 180, heating element 190, adjustable knob 200, outer side wall 210, inner side wall 220, right side wall 230, left side wall 240, and revolving shaft 400.

FIG. 2 illustrates the invention being used with the heating element 190 in the center of the electric oven body 110, with the food rack 150 at its lowest position in the oven body 110. This configuration is used when a small, thin food is being cooked or when bread is being toasted.

Shown in FIGS. 3A-3D is a preferred embodiment of the present invention in which the upper heating element 190 is connected to a heat directing plate 700, with the heat directing plate 700 situated above the upper heating element 190 so that it directs heat down onto the food. This embodiment would allow an even faster cooking or browning of food. The heat directing plate may be made of any material, including but not limited to, metals, glass, plastics, rubbers, and it may be any shape desired. The preferred material is metal and the preferred shape is rectangular. In the preferred embodiment of the present invention, the upper heating element 190 is vertically movable, meaning it is capable of moving down towards oven bottom 130, or up towards oven top 140.

Figure 3A:
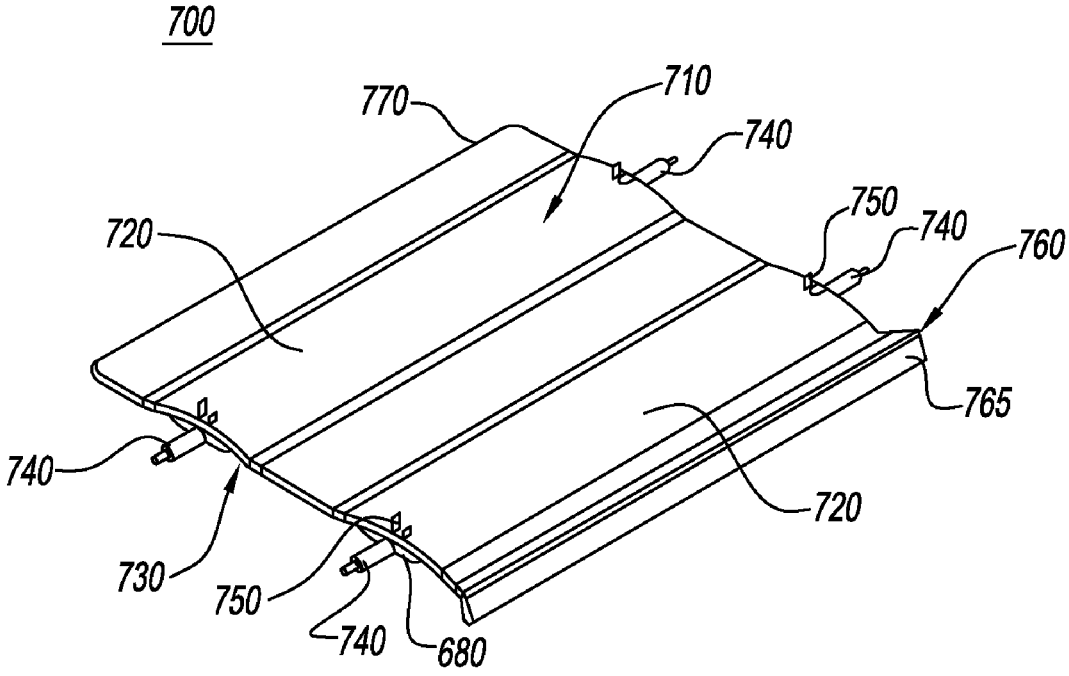
FIG. 3A is a top perspective view of the heat directing plate

Shown in FIG. 3A is a perspective view of the heat directing plate 700. Also shown are a top surface 710, a bottom surface 715, a convex curvature 720, a concave curvature 730, a sliding terminal 740, an attachment point 750, a front of the heat directing plate 760, a front flap 765, a back of the heat directing plate 770, additional mount points 780.

The upper heating element 190 may be disposed between two parallel sliding terminals 740, or it may be disposed on a separate attachment. Preferably, the sliding terminals 740 may also serve as terminals for the upper heating element 190 and function as an insulated conductor of electric current between the wiring disposed in the body 100 and the upper heating element 190. In such embodiment the sliding terminals 740, or simply terminals, would double as a heating element terminal 380. The sliding terminals 740 may be attached within attachment points 750, which may be slide-in or snap-in tabs and slots, or they may be permanently fastened, glued, welded or riveted into place. Additional mount points 780 may be present to provide a strong and durable engagement between the sliding terminal 740 and the heat directing plate 700. The sliding terminals 740 would travel vertically within the vertical side slots 300, and connect directly or indirectly to a support arm 370 or 375.

Figure 3B:
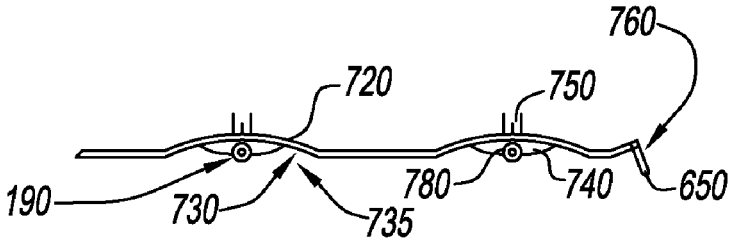
FIG. 3B is a side view of the heat directing plate.

The surface of the heat directing plate 700 is preferably contoured, as shown in FIGS. 3A and 3B. The contours provide for a substantial encirclement of the upper heating element 190 and thus increase the benefit and efficiency of the present invention. The convex surface 710 is a result of the fact that the heat directing plate 700 is preferably thin, to reduce weight, but is otherwise not needed. As shown in FIGS. 3A and 3B the upper heating element is disposed inside the cavity 735 that is formed by the convex surface 730. The concave surface 730 may additionally be of a highly reflective and heat resistant material, such as brushed steel or a stainless steel, so as to reflect as much heat as possible. The heat radiated by the upper heating element 190 and the lower heating element 195 gets trapped by the bottom surface 715, and specifically within the concave surface 730, and is reflected back towards the area between the two heating elements 190 and 195, thus magnifying the heat exposure of a food item disposed there between.

The design of the heat directing plate 700, which may also be known as the reflector plate, is such that it has several included surfaces that coincide with the heating element and are radiused in such a way as to optimize the reflective properties of the radiated heat to the cooking area. For optimal output of the present invention, it may be preferable to lower the upper heating element 190 and the heat directing plate 700, so that the food becomes encapsulated between the top and bottom heating elements 190 and 195, or at equal distances between them. This setting creates a much greater heating/roasting/broiling/toasting efficiency due to its unique shape, design and properties.

Figure 3C:
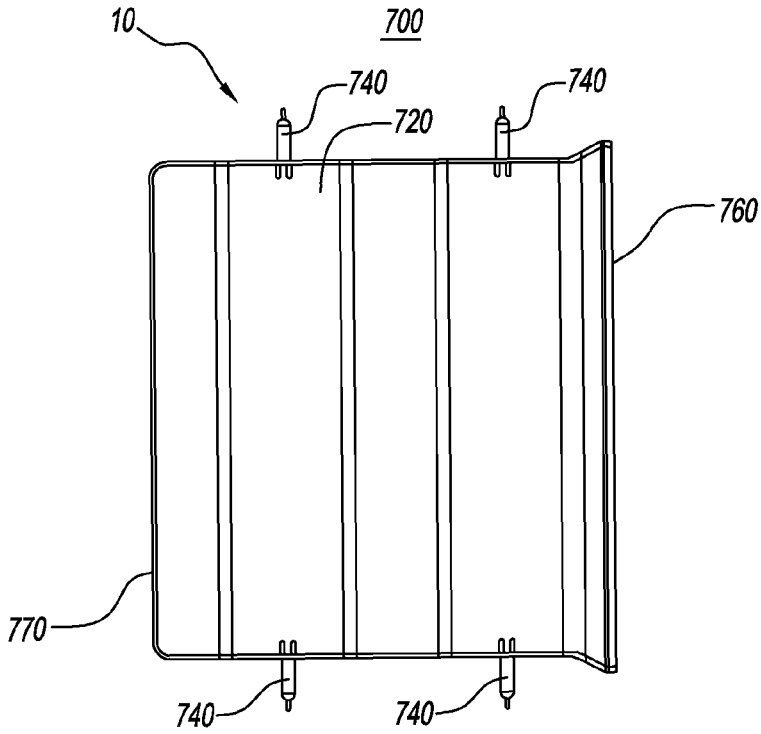
FIGS. 3C and 3D are top and bottom view of the heat directing plate.
Figure 3D:
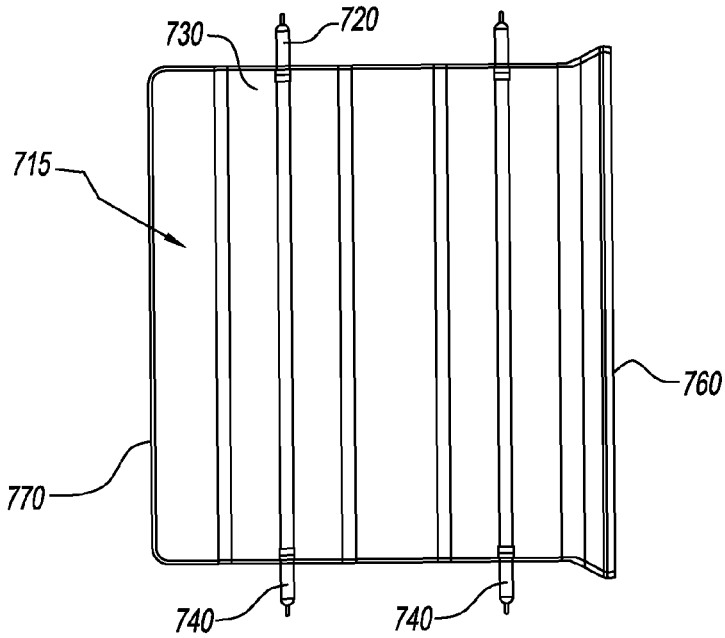

FIGS. 3C and 3B show top the heat directing plate 700, the top surface 710, the bottom surface 715, the convex and concave curvatures 720 and 730, sliding terminals 740, an attachment point 750, a front of the heat directing plate 760, a front flap 765, a back of the heat directing plate 770, additional mount points 780. The front flap 765 preferably contains a cautionary message for a user of the present invention. The message is recommended since at the time when the heat directing plate 700 is substantially lowered, the top surface 710 becomes exposed to view, which may result in someone being tempted to place food items upon it. In an alternative embodiment, the top surface 710 may also be used in food preparation; for example, for gentle heating of delicate food items. The heat directing plate 770 may be removable for cleaning or repair, or may be permanently affixed into place.

Illustrated in figs is the preferred embodiment of the lifting unit that serves as a mechanism for raising and lowering the upper heating element 190. The preferred lifting mechanism for the lifting unit is a series of interlocking gears or a gear system. Specifically, the mechanism preferably is made up of a lower interactive connecting gear and at least one upper interactive connecting gear, with the lower interactive connecting gear preferably connecting to the adjustment knob 200. The adjustment knob 200 may connect to a rotating shaft 400 that traversed the body of the oven 100, and supports a lifting unit on the opposite side for a uniform and even vertical motion.

Furthermore, with the gear system design of the lifting unit 320, the top heating element 190 may be capable of locking into place in a multitude of positions between the top most position, which is near the top of the oven 140, and the bottom most position, which is near the bottom of the oven 130. The locking is achieved through a friction lock, whereby the mechanism is under friction and when released tends to stay in the set position until moved again. Such mechanism is especially preferred here, since it is capable of functioning as a safety backup, in case an actual lock accidently or deliberately fails to engage, a friction lock is likely to still prevent the upper heating element 190 from falling onto an inserted body part, while the upper heating element 190 is still hot.

The preferred lifting mechanism embodied in a gear system represents a significant improvement over prior art due to its smooth operation, requiring uniform effort to raise and lower the lifting unit no matter where the heating element 190 may be located in the oven 100; but more importantly, it is safer due to the presence of a friction lock, since such a lock may always hold the hear mechanism in check. Additionally, an actual or true lock may be present in an embodiment of the present invention.

A mechanism may be a combination of gears, such as, but not limited to, spur gears, helical gears, double helical gears, bevel gears, hypoid gears, crown or worm gears, non-spherical gears, as well as rack and pinion mechanisms or sun and sphere mechanisms or any other combination of gears. Preference may be given to gear mechanisms that are especially known for increased friction between gear wheels, such as a worm gear or a helical gear. However, any other gear mechanism or a combination of gears with different mechanisms may be used, and friction may be increased or decreased by calibrating the interference, depth of engagement or interference of interlocking teeth with other, or adjusting any other variables that impact the frictional coefficient of the overall gear mechanism.

In an embodiment utilizing a worm or a rack and pinion gear combination, or any other gear combination, for the lifting unit mechanism 310, the lifting unit 320 may have the pinion wheel or gear wheel connected to the adjustment knob 200 either directly or through intervening gear wheels. The pinion or gear wheel would then act on a worm or rack rail gear that may be attach perpendicularly to the horizontal support 375. However, any other configuration of gears may achieve the same or similar preferred results. As such our unit 100 can boast a top heating element 190 that glides through several positions in which it can be retained or "locked" into any of these positions, the preferred minimum number of adjustable positions is set at three; however, a gear mechanism may make the number of positions adjustment close to infinity or at least between two and twenty different settings.

A preferred gear mechanism may contain a true locking function of the upper heating element 190. One example of a true locking function would be a pin to the gear system, for example that would engage the gears and prevent them from any rotation until the pin is removed. The pin could be removed by an actuator button or lever which would need to be simultaneously pressed or activated while turning the knob to adjust the top heating element. Although not shown, the height of the lower heating element 195 may also be made adjustable, either separately or in concert with the upper heating element 190, using the same or different mechanism.

FIG. 3 is a front view of a preferred embodiment of the invention. FIG. 3 shows electric oven 100, electric oven body 110, electric oven door 120, electric oven bottom 130, electric oven top 140, food rack 150, food rack positioning tabs 155, heat setting 160, time setting 170, temperature setting 180, heating element 190, adjustable knob 200, outer side wall 210, inner side wall 220, right side wall 230, left side wall 240, and revolving shaft 400.

FIG. 3 illustrates the food rack 150 suspended in the food rack positioning tabs 155, with the heating element 190 just above the food. This configuration is used when one desires more flow around the bottom of the food, or if there is a bottom heating element 190 and one prefers the top of the food to be browned or to be cooked faster than the bottom of the food.

Figure 3G:
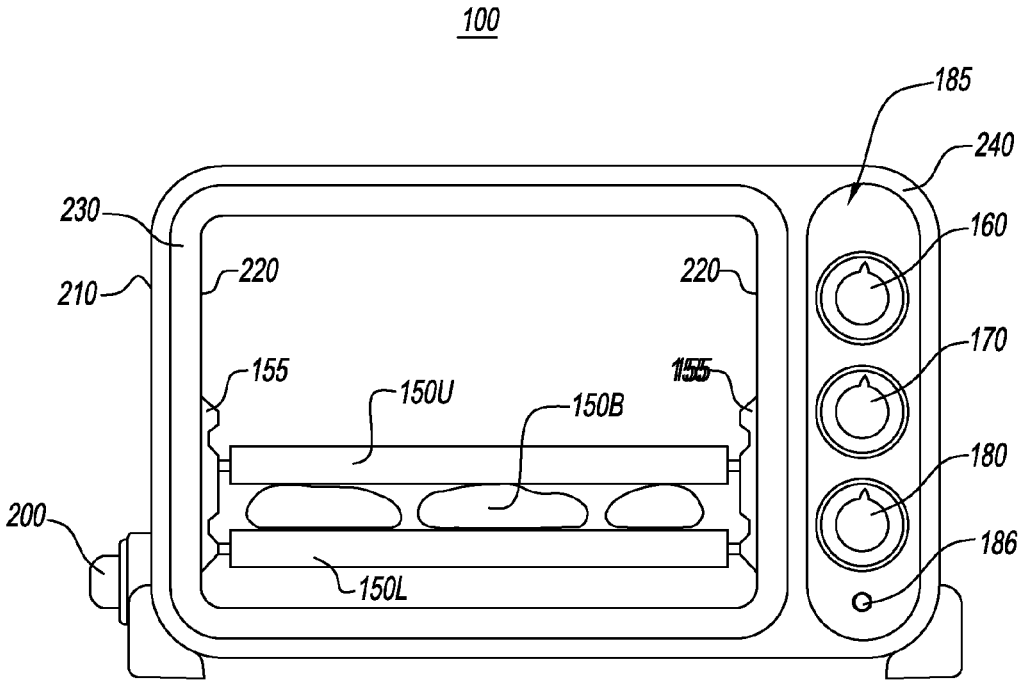
FIG. 3G is a view of dual racks
Figure 3H:
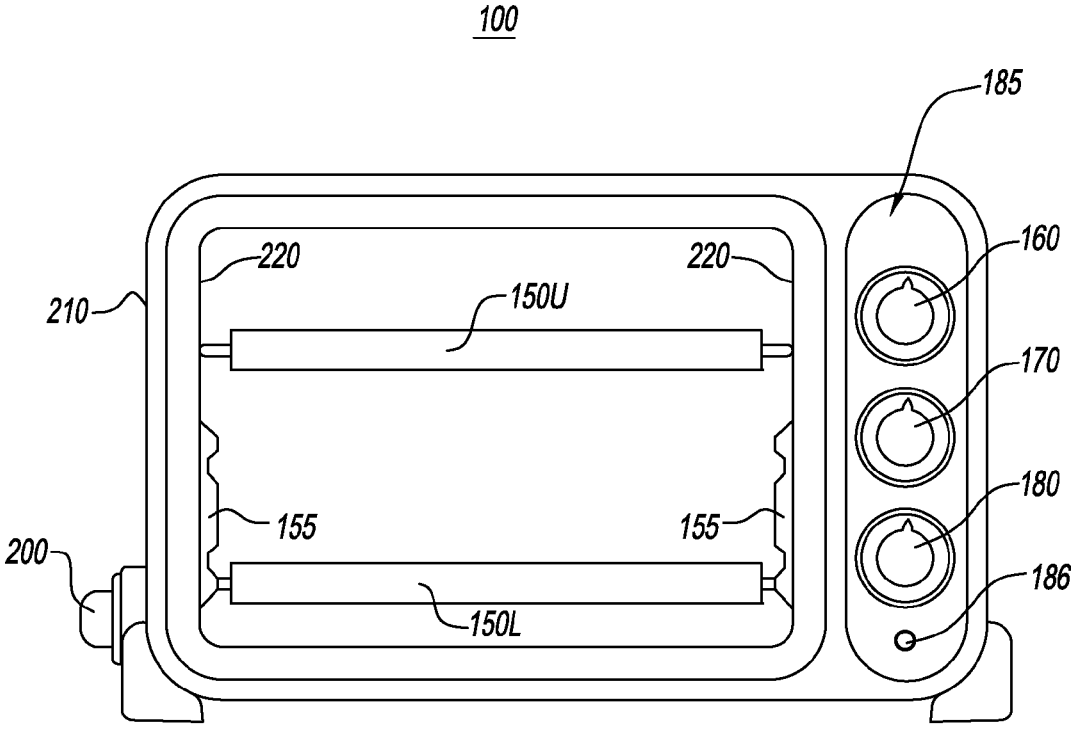
FIG. 3H is another view of the dual racks that are used to bake Panini bread.

FIGS. 3G-3J illustrate the versatility of the present invention. Shown in FIGS. 3G and 3H is an embodiment of the oven 100 having at least 2 racks 150, that may also be referred to as removable racks, since they may are preferably easy to remove for cleaning or repair. The racks 150 may be supported by the food rack positioning tabs 155 or secured directly within slots in the inner sidewalls 220. At least two racks may be needed to prepare an increased number of foods, or to shield a lower food item with an upper food item, such as when a lower food item may have a delicate nature. Another reason for using more than one rack to leave a desirable grill marking on the food item, for example on meets, vegetables, or breads. The dual racks 150, as shown in FIGS. 3G and 3H may be used to bake or grill Panini style bread, or any bread. Both the upper rack 150U and the lower rack 150L may be adjustable to fully enclose or reveal the food item 150B.

Also shown in FIGS. 3G and 3H is an instrument panel 185, a having heat setting 160, a time setting 170, a temperature setting 180, an adjustable knob 200, an outer side wall 210, an inner side wall 220, a right side wall 230, a left side wall 240, and an indicator light 186. The indicator light 186 may also contain, or may alternatively function as, a light sensor. As a light sensor the indicator 186 may perceive when a light has been turned off, to either, or both, sound an alert or turn off the heating elements 190 and 195. This may be an added safety or efficiency feature so that the oven 100 should not be "forgotten" in an ON state or with food items still inside. In yet another alternative, such a sensor may be overridden, which may also be set to specific time duration.

Figure 3I:
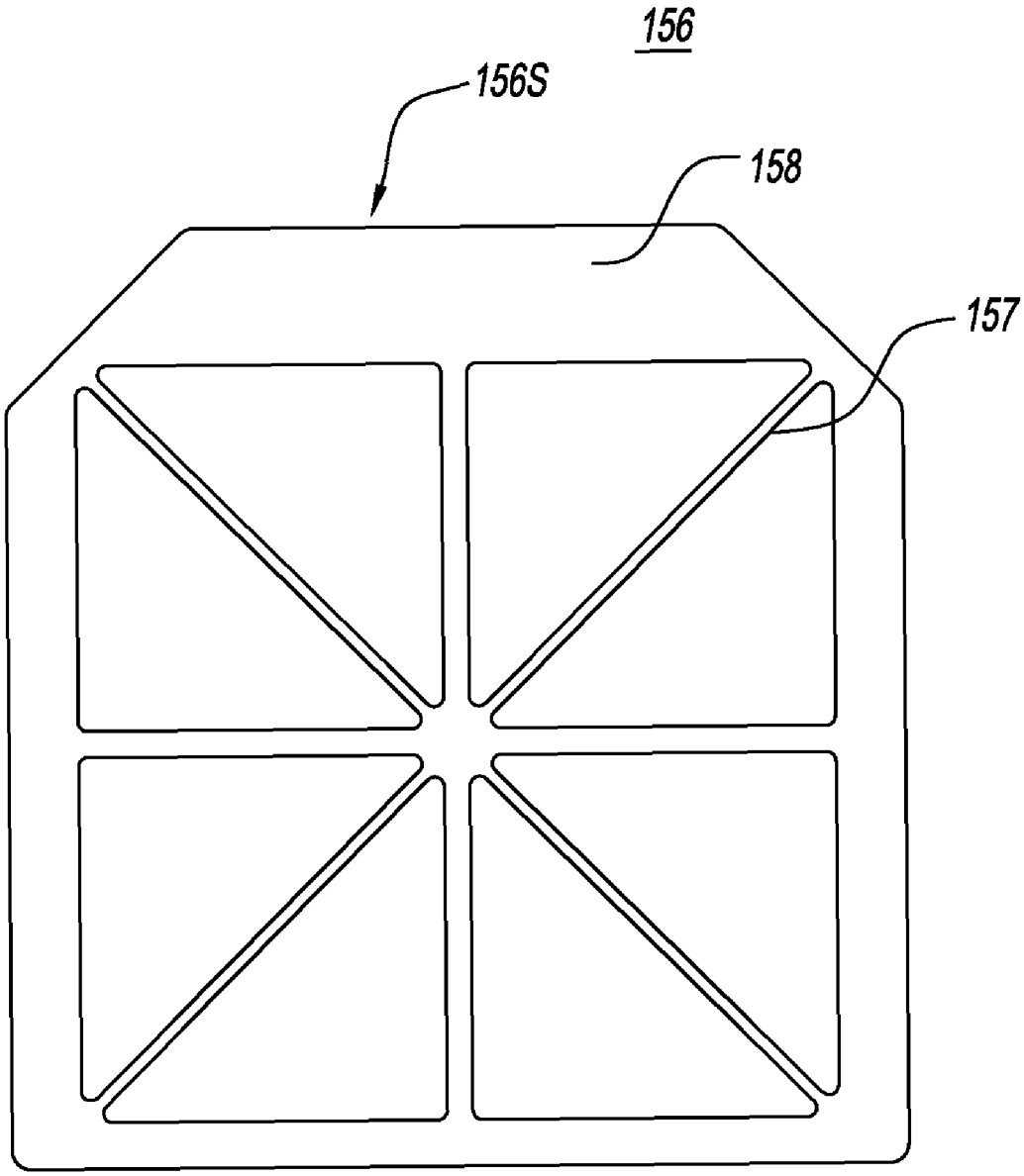
FIG. 3I is a top view of a rack with pocket indentations for sandwich grilling.
Figure 3J:
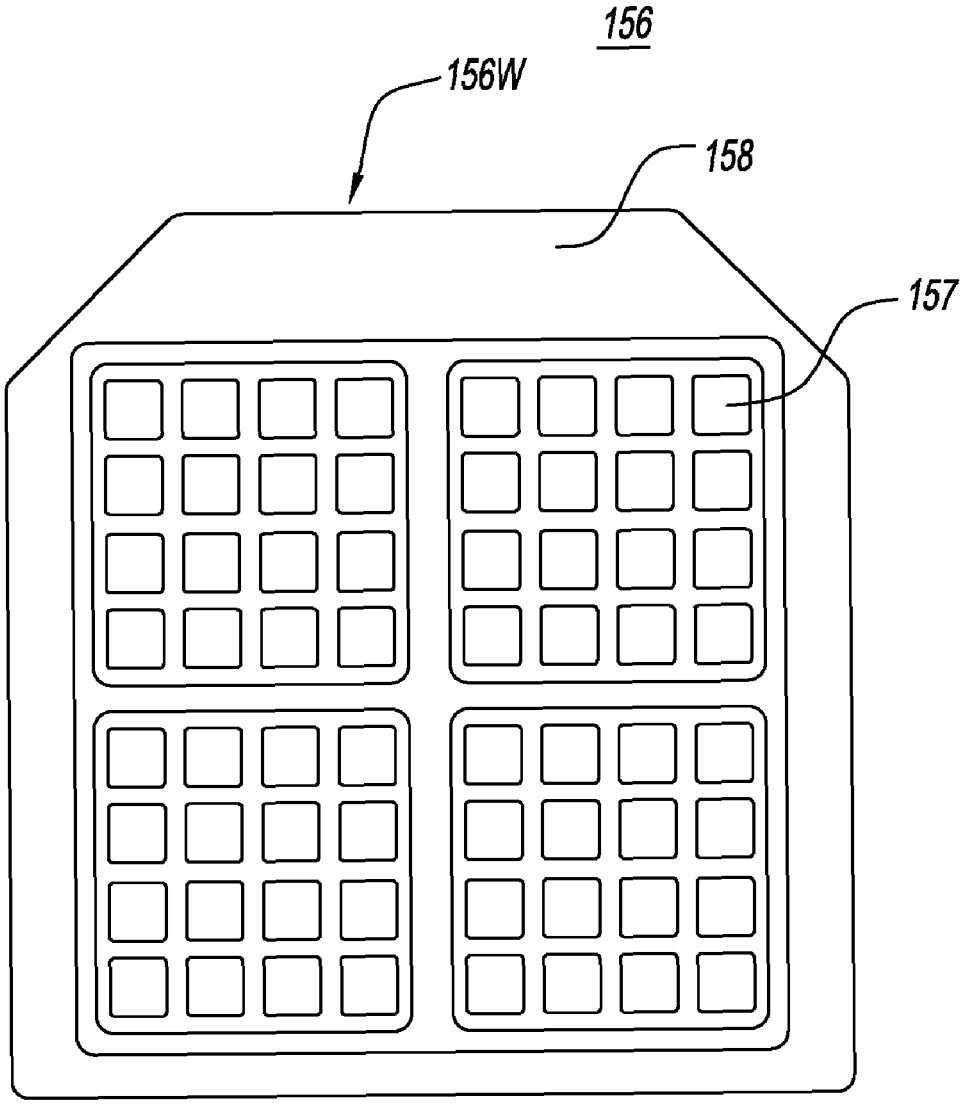
FIG. 3J is a top view of a rack with square indentations for waffle making.

FIGS. 3I and 3J illustrate some of the trays 156 that may be used with the oven 100. Alternatively, these may be racks 150. The difference is that a tray 156 is supported by a rack 150, or directly by the food rack positioning tabs 155. Illustrated in FIG. 3I is a sandwich tray 156S and in FIG. 3J a waffle tray 156W. The trays 156 also have a front tab 158 for securely holding and handling the tray 156. The tab preferably faces the oven door 120 for easier access and egress of the trays 156.

As seen in FIGS. 3G and 3H, the racks 150 are preferably in a parallel and cooperating orientation to each other. This means that the racks 150 are preferably opposite each other and stacked on the same plane. It may also be preferable that the surfaces of the racks 150 that face each other have corresponding curvatures, bars or indentations, so as to create a pinching effect on food items. This may serve to create grill lines and it may further facilitate the swiftness of food preparation made possible with the present invention. Similarly, the trays 156 may have cooperating and corresponding surfaces and surface features. Alternatively, a tray 156 may be strapped (not shown) unto the upper rack 150U with another tray placed unto the lower rack 150L. The racks 150U and 150L may then be brought together until the opposite trays pinch or encapsulate a food item. Other types of trays 156 or plates may be utilized, such as, but not limited to a grill plate, Panini plate, bread plate, pocket plate, or a waffle plate, or any combination thereof, or any other type of a plate, tray or rack.

The sides of the rectangle may be angled down to form a type of hat to further increase heat direction toward the food.

The heat directing plate 700 may be one piece or may consist of multiple pieces. If multiple pieces are employed, the pieces may be joined in any effective manner.

Figure 4:
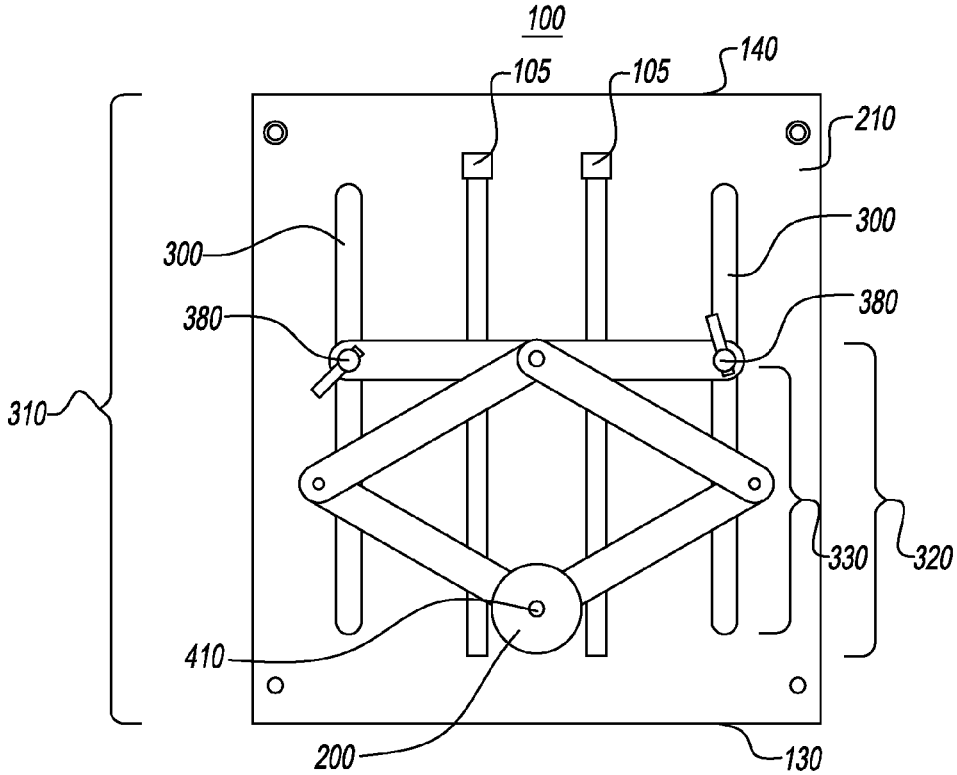
FIG. 4 is a side view of one embodiment of the invention.
Figure 5:
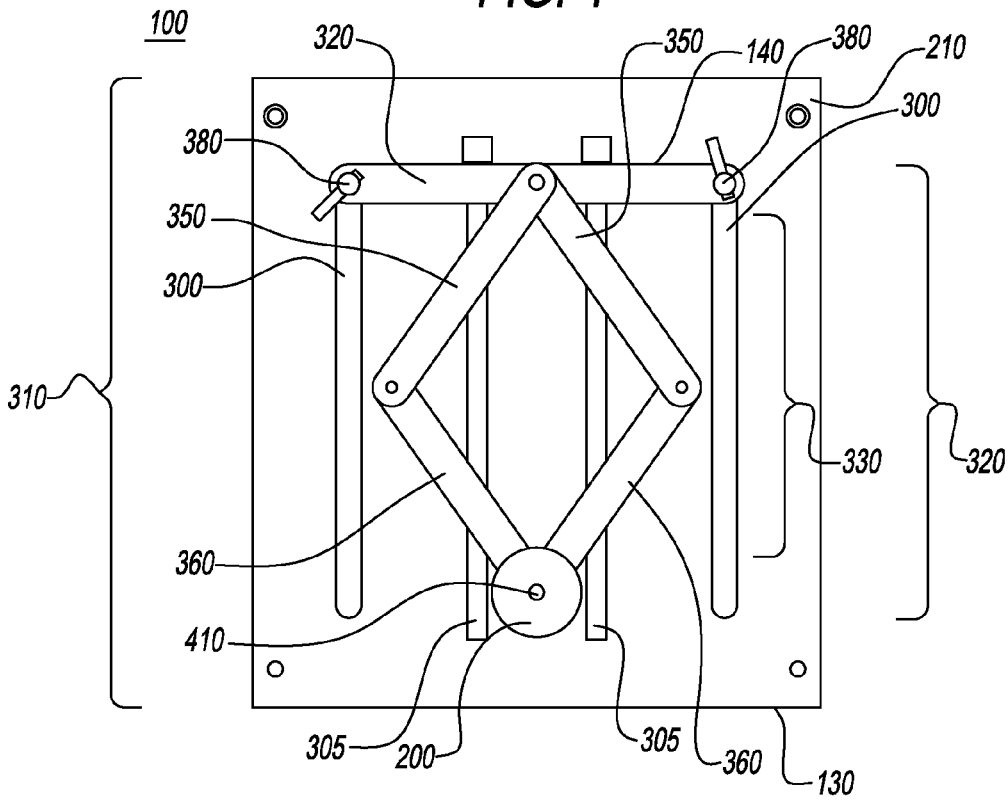
FIG. 5 is a side view of one embodiment of the invention.

FIGS. 4 and 5 are side views of one embodiment of the invention. FIGS. 4 and 5 illustrate the alternative embodiment of a mechanism 310 for moving the upper heating element 190. A reference to a heating element should be taken to mean the upper heating element 190, unless other wise stated. FIG. 4 shows the mechanism 310 when the heating element 190 is in the center of the electric oven body 110, and FIG. 5 shows the mechanism when the heating element 190 is at the top of the electric oven body 110.

FIG. 4 is a side view of the invention that shows a detailed view of the mechanism 310 used to move the heating element 190. FIG. 4 shows electric oven 100, electric oven bottom 130, electric oven top 140, adjustable knob 200, outer side wall 210, vertical side slot 300, stabilizing rod 305, mechanism 310, lifting unit 320, diamond shaped frame 330, upper interactive connecting rod 350, lower interactive connecting rod 360, support 370, heating element terminal 380, spring 390, and revolving shaft terminal 410.

FIG. 5 is a side view of the invention that shows a detailed view of the mechanism 310 used to move the heating element 190. FIG. 5 shows electric oven 100, electric oven bottom 130, electric oven top 140, adjustable knob 200, outer side wall 210, vertical side slot 300, stabilizing rod 305, mechanism 310, lifting unit 320, diamond shaped frame 330, upper interactive connecting rod 350, lower interactive connecting rod 360, support 370, heating element terminal 380, spring 390, and revolving shaft terminal 410.

The mechanism 310 operates in the following manner. A user turns the adjustable knob 200, which is connected to the revolving shaft 400. The revolving shaft 400 is connected to a lower interactive connecting rod 360 of the diamond shaped frame 330. The revolving shaft 400 drives the lifting unit 320, so that if the user wishes to raise the heating element 190, the diamond shaped frame 330 is forced upward when the user turns the adjustable knob 200 to the 'upper' position.

The heating element 190 is connected to the support 370 through the heating element terminal 380 at the top of the diamond shaped frame 330, therefore it is forced upward when the diamond shaped frame 330 and support 370 are forced upward. The heating element 190 slides through the vertical side slots 300 when it moves upward, so that force exerted on the outside of the electric oven is transferred to the heating element 190 inside the electric oven. The stabilizing rods 305 keep the support stable and horizontal as it moves. One or more heating elements may be used, or the heating element may have one or more horizontal sections. As shown in the figures, the heating element 190 has two horizontal sections, and is connected to the support 370 through both.

Figure 6:
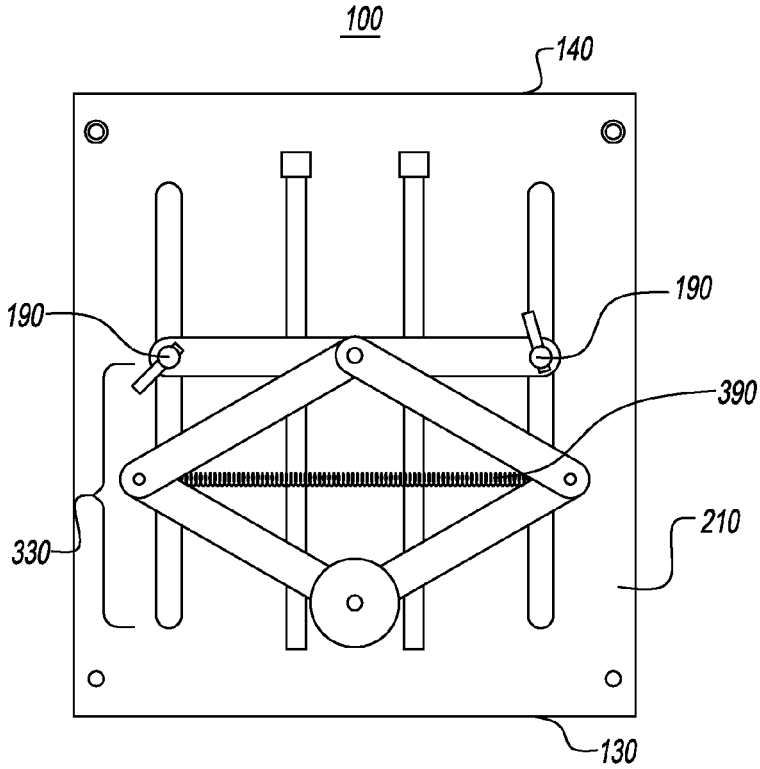
FIG. 6 is a side view of an alternate embodiment of the invention.
Figure 7:
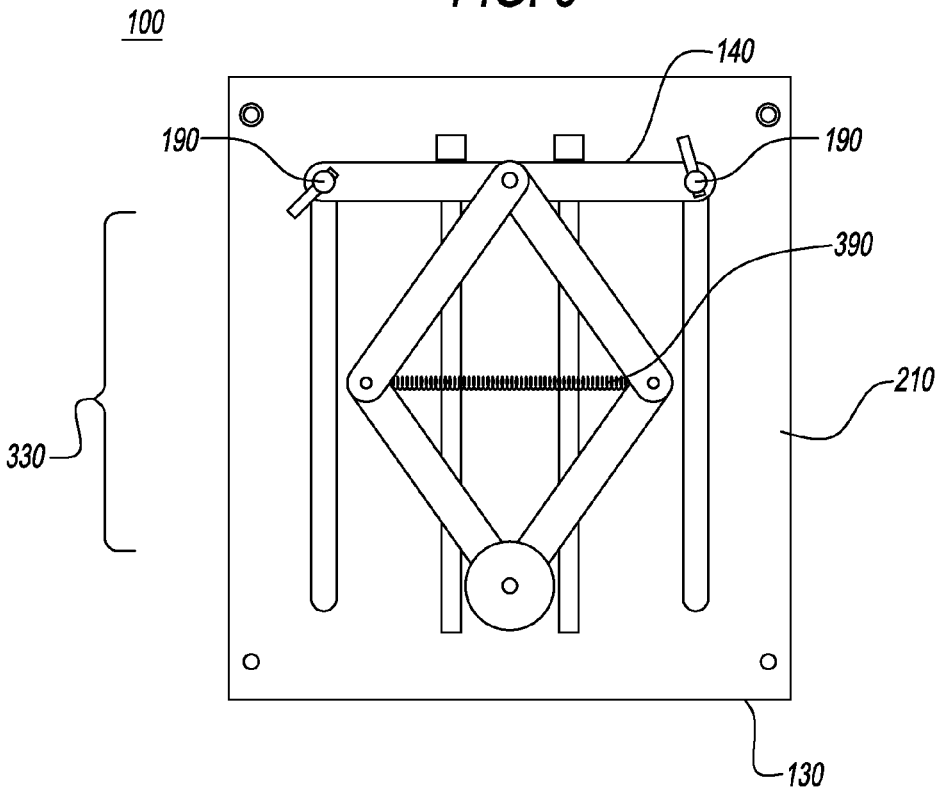
FIG. 7 is a side view of an alternate embodiment the invention.

FIGS. 6 and 7 are side views of another alternate embodiment of the invention. They show the embodiment of FIGS. 4 and 5 with a spring 390 added to the diamond shaped frame 330; some numbering has been left off of FIGS. 6 and 7 for clarity. The spring 390 adds stability to the mechanism 310.

FIG. 6 shows the invention with the heating element 190 in the center of the inside of the electric oven 100, electric oven bottom 130, electric oven top 140, outer side wall 210, diamond shaped frame 330, and spring 390.

FIG. 7 shows the invention with the heating element 190 at the top of the inside of electric oven 100, electric oven bottom 130, electric oven top 140, outer side wall 210, diamond shaped frame 330, and spring 390.

Figure 8:
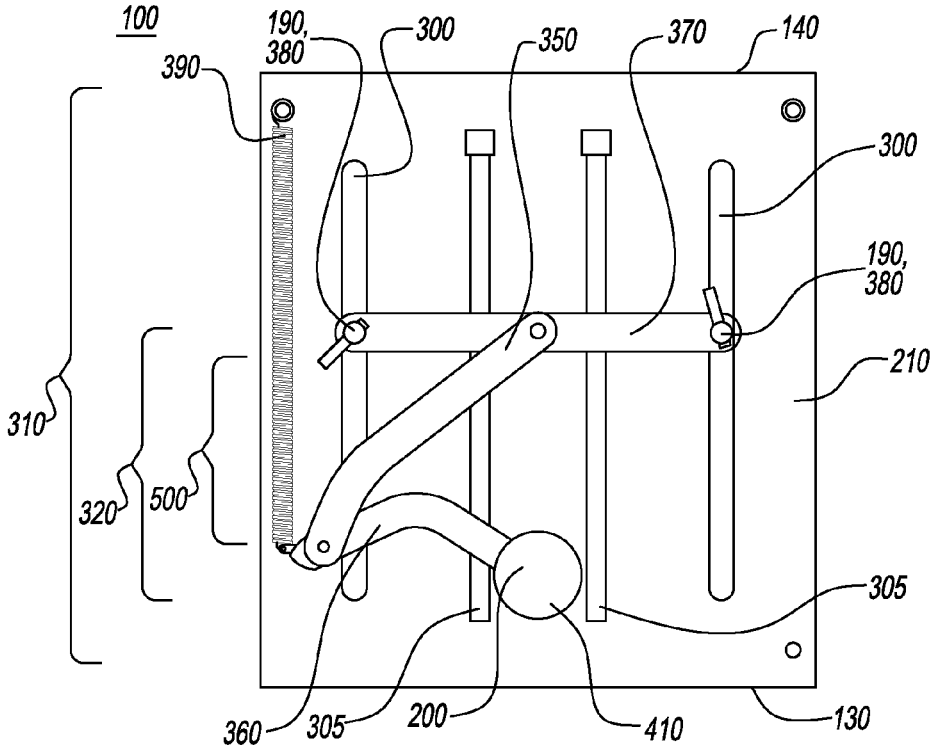
FIG. 8 is a side view of an alternate embodiment the invention.

FIG. 8 is a side view of an alternate preferred embodiment the invention with the heating element 190 in the center of the electric oven 100, electric oven bottom 130, electric oven top 140, adjustable knob 200, outer side wall 210, vertical side slot 300, stabilizing rod 305, mechanism 310, lifting unit 320, upper interactive connecting rod 350, lower interactive connecting rod 360, support 370, heating element terminal 380, spring 390, revolving shaft terminal 410, L-shaped lifting unit 500.

Figure 9:
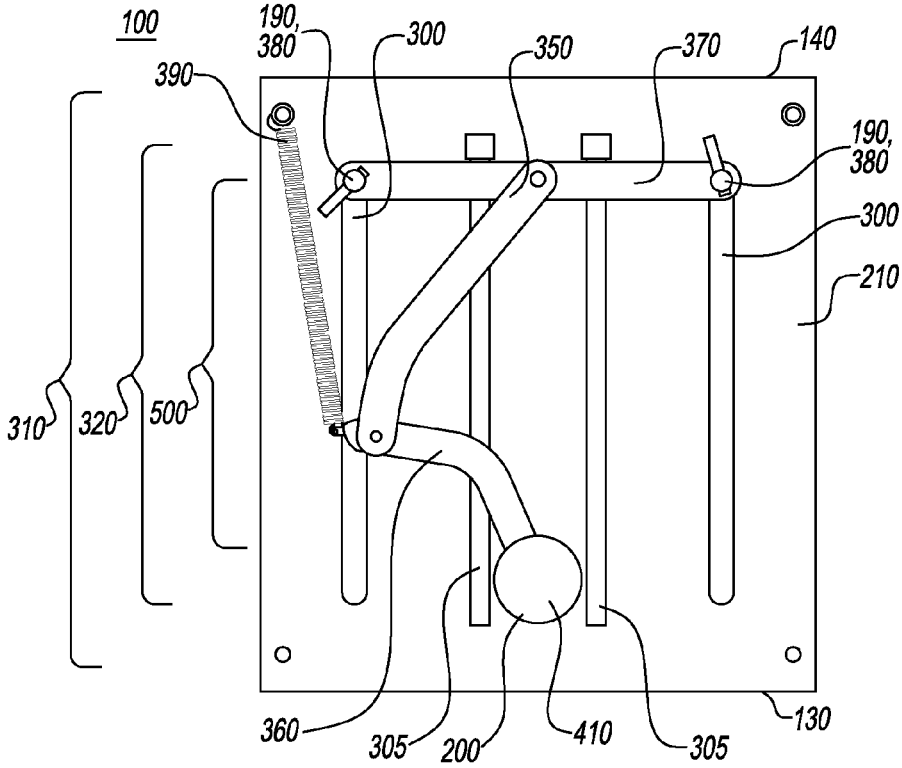
FIG. 9 is a side view of an alternate embodiment the invention.

FIG. 9 is a side view of an alternate preferred embodiment the invention with the heating element 190 at the top of the inside of the electric oven 100, electric oven bottom 130, electric oven top 140, adjustable knob 200, outer side wall 210, vertical side slot 300, stabilizing rod 305, mechanism 310, lifting unit 320, upper interactive connecting rod 350, lower interactive connecting rod 360, support 370, heating element terminal 380, spring 390, revolving shaft terminal 410, L-shaped lifting unit 500.

In this preferred embodiment, there is an L-shaped lifting unit formed from an upper interactive connecting rod 350 connected to the support 370, and a lower interactive connecting rod 360 connected to a spring 390, the adjustable knob 200, and the revolving shaft terminal 410. A spring 390 is attached at the union of the two interactive connecting rods. The support 370 is connected to the heating element 190 as in the previous embodiment, (FIGS. 4-7), the lower interactive connecting rod 360 is connected to the revolving shaft shown in FIGS. 1-3, and the heating element 190 traverses the vertical side slots 300 to move up and down within the electric oven 100. The heating element 190 height may be adjusted to be employed at any vertical position inside the oven body.

This embodiment has the same configuration on both the right side wall and left side walls of the invention, except that the adjustable knob 200 is only present on one of the two sides.

The shape of the interactive connecting rods in this embodiment leads to a scissoring movement when the adjustable knob is turned to activate the revolving shaft. The scissoring movement makes the invention easier to use and maintain than specimens in the prior art, because there are fewer moving parts and it is a simpler, yet still effective, design that yields a fluid movement of the mechanism.

In one embodiment, there is a spring installed that connects the L-shaped lifting unit to the body. This adds stability and safety to the invention.

Figure 10:
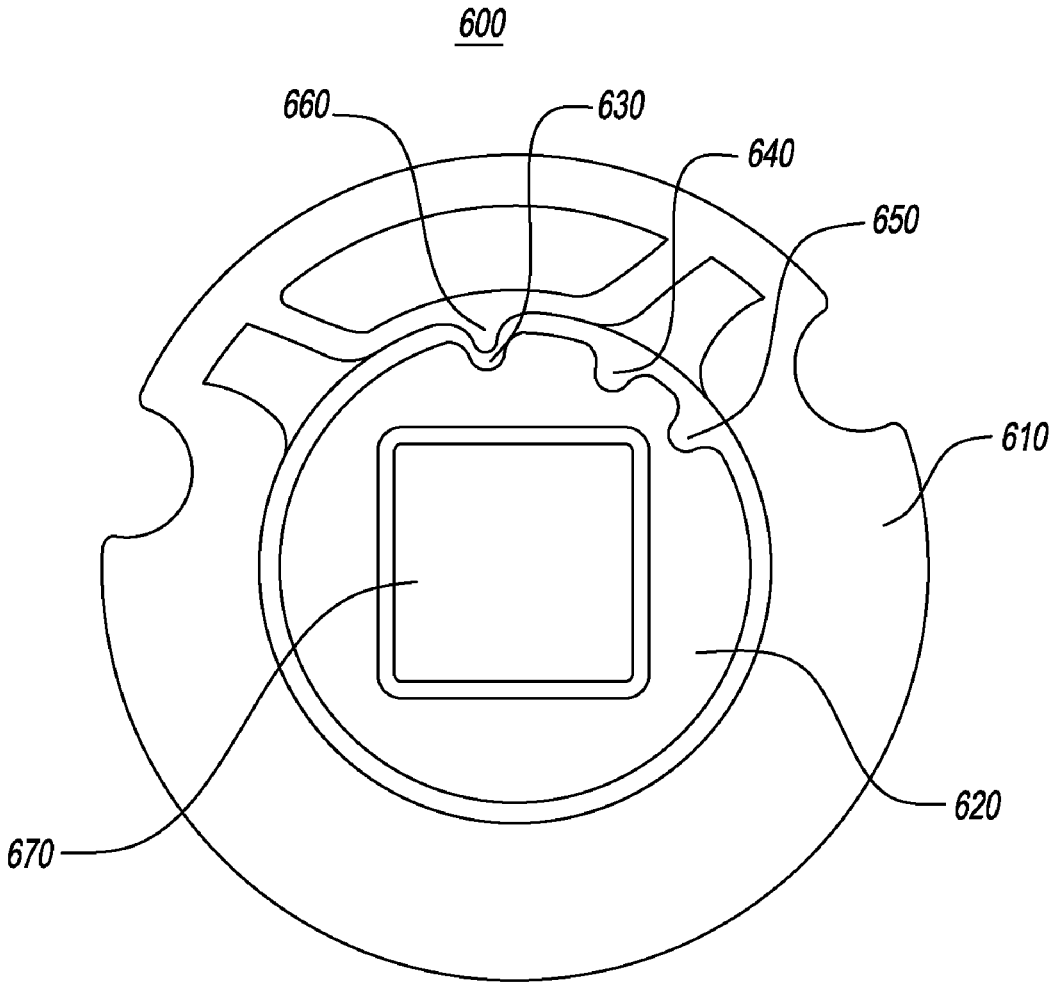
FIG. 10 is an exploded view of the gear portion of the invention.

FIG. 10 is an exploded view of the gear portion of one embodiment of the invention. FIG. 10 shows the gear 600, with gear outer housing 610, gear inner housing 620, first gear setting 630, second gear setting 640, third gear setting 650, gear locking mechanism 660, and revolving shaft port 670. The revolving shaft passes into the gear through the revolving shaft port 670.

When the shaft is turned, the gear outer housing 610 stays stationary, while the gear inner housing 620 turns. The gear locking mechanism 660 flexes to allow movement of the gear inner housing 620. When a gear setting (in FIG. 10 the first gear setting 630), aligns with the gear locking mechanism 660, the two components are locked together in a reversible manner. This provides stability for the heating element at a position determined by the gear setting. If a different heating element position is desired, the revolving shaft is turned and the gear locking mechanism 660 is locked together with a different gear setting.

In the embodiment illustrated in FIG. 10, the heating element can be moved to one of three positions corresponding to one of the three gear settings; the number of positions depends on the number of gear settings. Although the gear 600 is shown with three gear settings, it may have any number of gear settings, with a preferred number from of settings from one to 50, with the most preferred number of settings being three as shown in FIG. 10.

Figure 11:
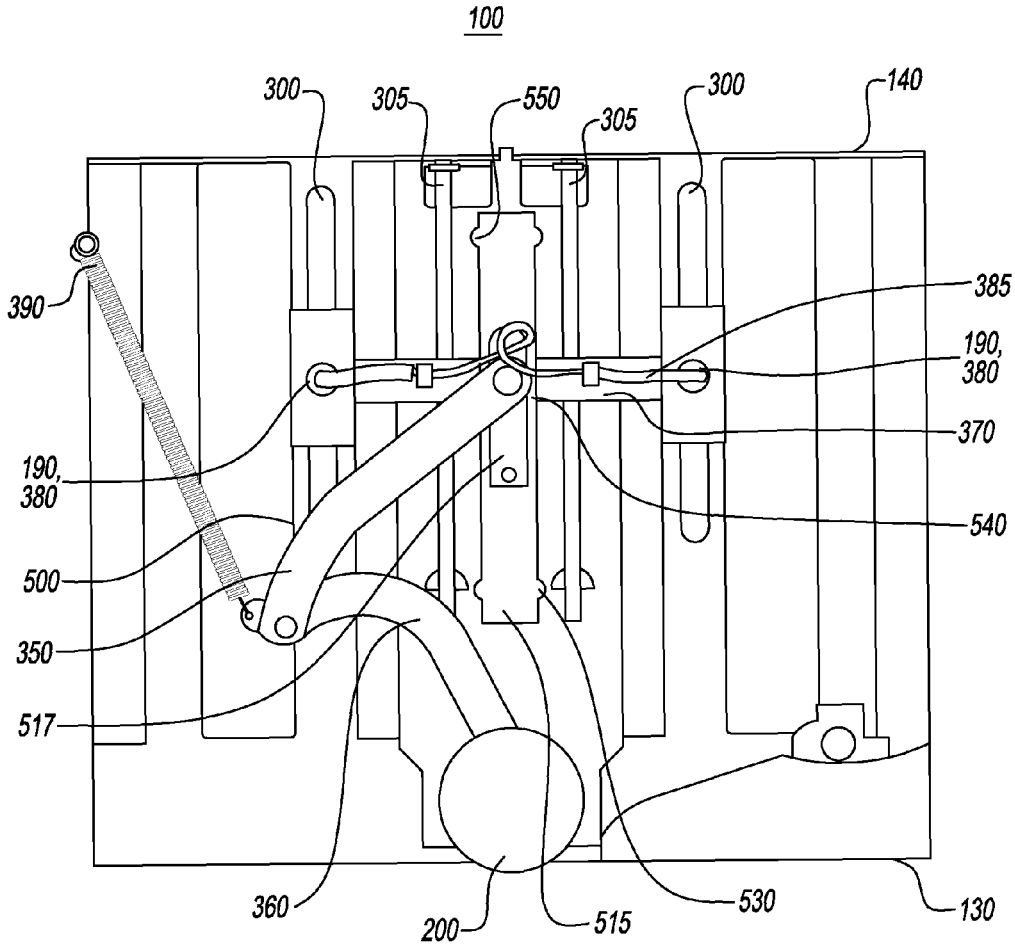
FIG. 11 is a side view of an alternate, preferred embodiment of the invention.
Figure 12:
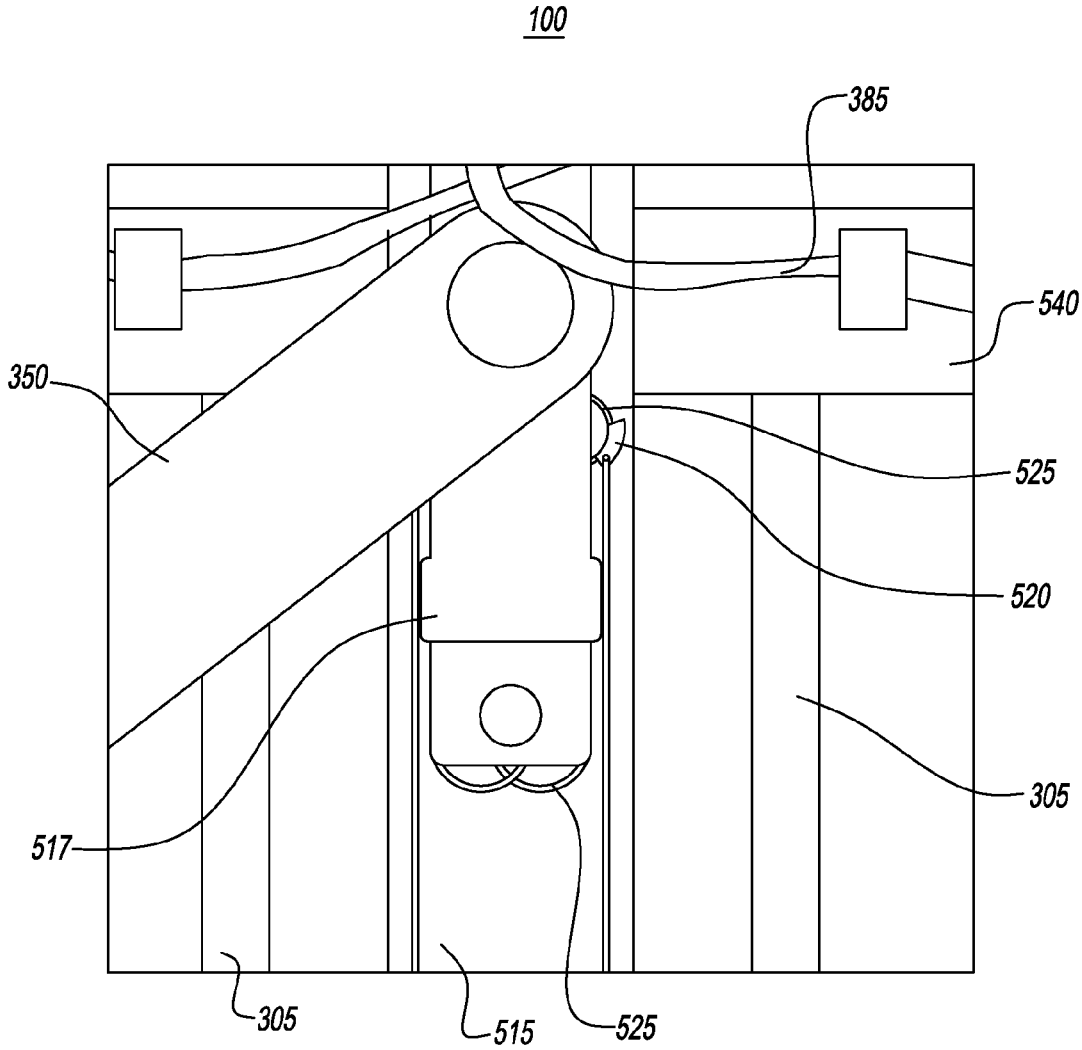
FIG. 12 is an exploded view of the embodiment of FIG. 11.

FIGS. 11 and 12 show a side view of an alternate, preferred embodiment of the invention. FIG. 11 shows the entire side of the invention, and FIG. 12 shows an exploded view of a distinguishing feature of this embodiment. This embodiment is similar to the embodiment shown in FIGS. 8 and 9, but has added features that improve stability and ease of use.

FIG. 11 shows the invention with the heating element 190 in the center of the inside of the electric oven 100. Also shown are electric oven bottom 130, electric oven top 140, adjustable knob 200, vertical side slot 300, stabilizing rods 305, upper interactive connecting rod 350, lower interactive connecting rod 360, support 370, heating element terminals 380, conductive cable 385, spring 390, L-shaped lifting unit 500, vertical locking track 515, interlocking mechanism 517, first heating element position 530, second heating element position 540, and third heating element position 540.

In this preferred embodiment, there is an L-shaped lifting unit formed from an upper interactive connecting rod 350 connected to the support 370, and a lower interactive connecting rod 360 connected to a spring 390, the adjustable knob 200, and the revolving shaft terminal 410. A spring 390 is attached at the union of the two interactive connecting rods. This adds stability to the system. The support 370 is connected to the heating element 190 as in the previous embodiments, (FIGS. 4-9), the lower interactive connecting rod 360 is connected to the revolving shaft shown in FIGS. 1-3, and the heating element 190 traverses the vertical side slots 300 to move up and down within the electric oven 100.

This embodiment contains added features for stability and ease of use. The upper interactive connecting rod 350 is connected to the support 370 and also to an interlocking mechanism 517 which traverses the vertical locking track 515.

FIG. 12 shows an exploded view of the interlocking mechanism 517 and the vertical locking track 515. Shown is electric oven 100, stabilizing rods 305, upper interactive connecting rod 350, conductive cable 385, vertical locking track 515, interlocking mechanism 517, notch 520, spring coil 525, and second heating element position 540.

When the L-shaped lifting unit 500 and thus the heating element 190 is moved, the interlocking mechanism 517 moves with it up or down the vertical locking track 515; when the desired position is reached, the spring coil 525 in the interlocking mechanism 517 engages the notch 520 to keep the lifting assembly stable in the specified position. The tension of the spring coil 525 against the notch 520 keeps the L-shaped lifting unit and the heating element in place and adds stability to the invention that is not present in the prior art.

In this embodiment, there are three positions for the heating element 190 and three notches 520 to yield a first heating element position near the bottom of the electric oven 100, a second heating element position near the center of the electric oven 100, and a third heating element position near the top of the electric oven 100. Although the preferred embodiment contains three positions for the heating element 190, any number of positions may be employed, with any number of notches 520.

This embodiment has the same configuration on both the right side wall and left side walls of the invention, except that the adjustable knob 200 is only present on one of the two sides.

The invention and any or all of its components may be made from any suitable material, including but not limited to, metals, glass or glass products, plastics, rubbers, wood or paper products, or any combination of the above or other materials.

The overall size of the invention may be from 10-30 inches long by 4-20 inches high by 5-25 inches in depth, with preferred dimensions of 18.35 inches long by 10.96 inches high by 14.22 inches in depth.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. An article of manufacture, comprising:

an electric oven having a body for holding food, with a vertically movable heating element within the body;

said heating element connected to a lifting unit with an attached spring and a support bar that traverses at least one vertical side slot installed symmetrically on a right side wall and a left side wall of the body and a vertical locking track;

a locking mechanism attached to the support bar that traverses the vertical locking track; and a terminal connecting the heating element to the lifting unit.

2. The article of claim 1, wherein the mechanism has a lifting unit with a diamond shaped frame formed by four interactive connecting rods comprising two upper interactive connecting rods and two lower interactive connecting rods, wherein the upper two interactive connecting rods, and a heating element that passes through a side wall and traverses the body horizontally, are connected to a support, and the lower two interactive connecting rods are connected to a revolving shaft that passes through the lower side wall of the body and traverses the length of the body horizontally.

3. The article of claim 2, wherein the terminal of the revolving shaft is square and a section of the one of the lower interactive connecting rods has a corresponding square hole, while the other lower interactive connecting rod has a round hole.

4. The article of claim 2, wherein there is an adjustable knob installed on the outer side wall of the body that connects to the revolving shaft.

5. The article of claim 1, wherein there are two traction mechanisms, one on the left side and one on the right side of the oven body, and a revolving shaft traverses the oven body horizontally and passes through lower side walls of the body to connect to each of the two traction mechanisms.

6. The article of claim 2, wherein there is a spring installed between the right and left interactive connecting rods of the diamond shaped frame.

7. The article of claim 1, wherein there is a heat directing plate installed above the heating element.

8. The article of claim 7, wherein said heat directing plate encircles said heating element.

9. An article of manufacture, comprising:

an electric oven having a body for holding food with a vertically moveable heating element; said heating element connected to an L-shaped lifting unit with a lower interactive connecting rod and an upper interactive connecting rod, an attached spring, and a support bar that traverses vertical side slots and a vertical locking track; a locking mechanism attached to the support bar that traverses the vertical locking track; and a terminal to connect a heating element to the lifting unit.

10. The article of claim 9, where the vertical locking track has disposed on it notches and the locking mechanism has spring coils disposed on it that engage the notches on the vertical locking track.

11. The article of manufacture of claim 1, wherein the the lifting unit has a gear system and said gear system being checked by a gear locking mechanism.

12. The article of claim 9, further comprising a revolving shaft, a terminal end of said revolving shaft connecting to said lower interactive connecting rod, and said revolving shaft traversing said body horizontally.

13. The article of claim 11, wherein said gear locking mechanism is a frictional lock of said gear system.

14. The article of claim 9, further comprising at least two temporary racks in parallel cooperating orientation to each other, said racks having a form selected from a group comprised of a grill plate, Panini plate, bread plate, pocket plate, or waffle plate, or any combination thereof.

15. The article of claim 12, wherein there is an adjustable knob installed on the outer side wall of the body that connects to the revolving shaft.

16. The article of claim 9, wherein there is a heat directing plate installed above the heating element.

17. The article of claim 16, wherein said heat directing plate encircles said heating element.

* * * * *